US005513410A

United States Patent [19]

Liu

[11] Patent Number: 5,513,410

[45] Date of Patent: May 7, 1996

[54] TWIN STEMMED NURSING BOTTLE BRUSH

[76] Inventor: Chin C. Liu, No. 25, Lane 16, Tung Hsing St., Shu Lin Town, Taipei Hsien, Taiwan

[21] Appl. No.: 324,401

[22] Filed: Oct. 14, 1994

[51] Int. Cl.[6] ..... A46B 5/02

[52] U.S. Cl. ..... 15/106; 15/160; 15/164; 15/206

[58] Field of Search ..... 15/106, 164, 165, 15/206, 114, 118, 160, 211; D4/119

[56] References Cited

U.S. PATENT DOCUMENTS

| | | | |
|---|---|---|---|
| D. 250,068 | 10/1978 | Ducotey | 15/164 |
| 1,337,819 | 4/1920 | Braun | 15/206 |
| 3,076,988 | 2/1963 | Mills | 15/164 |
| 5,339,480 | 8/1994 | Murg et al. | 15/106 |

FOREIGN PATENT DOCUMENTS

| | | | |
|---|---|---|---|
| 977110 | 11/1975 | Canada | 15/206 |
| 1045017 | 6/1953 | France | 15/164 |
| 817513 | 7/1959 | United Kingdom | 15/164 |

*Primary Examiner*—Edward L. Roberts, Jr.
*Attorney, Agent, or Firm*—Pro-Techtor International

[57] ABSTRACT

A twin stemmed nursing cleaning brush comprises a junior brush stemmed from the middle or bottom portion of the main brush shaft to provide close contact with the bottle, bottle neck and its outer threads, pacifier, nipple cover and its inner threads when cleaning by either rotating the object or the brush assembly. Thus, this thorough interior and exterior nursing bottle cleaning device presents effective and convenient operation, as well as for easy storing.

3 Claims, 8 Drawing Sheets

TWIN STEMMED NURSING BOTTLE BRUSH

BACKGROUND OF THE INVENTION

1. Field of the Invention

The present invention relates to a nursing bottle brush with a junior brush attached to the main brush in particular for fast cleaning.

2. Description of the Prior Art

Nursing bottle consist of bottle, pacifier and nipple cover. All of which are in need of cleaning before use, especially when infant is in its early stage of life. The proper procedures are to clean the residue left on all three components first, then to sterilize in boiling water. Traditionally, a large brush is used to clean bottle, and a short, small brush is used to clean the pacifier and nipple cover threads; and the threads on the bottle are cleaned with regular cleaning pad. To clean every bottle, two very different brushes and a cleaning pad are applied. The smaller brush is easily misplaced in the kitchen, and the cleaning pad may easily be contaminated by its multiple usages. Yet, to ensure the job is done properly, none of those tools may be deleted.

SUMMARY OF THE INVENTION

The purpose of the present invention is to offer a twin stemmed brush system, in particular, a secondary brush attached to the top, middle, or the bottom part of the main brush for easy operation to clean nursing bottle. When rotating the twin stemmed brush, the secondary brush may clean the threads on bottle, nipple cover at the same time. Due to its one bodied formation, the secondary brush may not be lost, or misplaced, and it is quite easy to operate.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
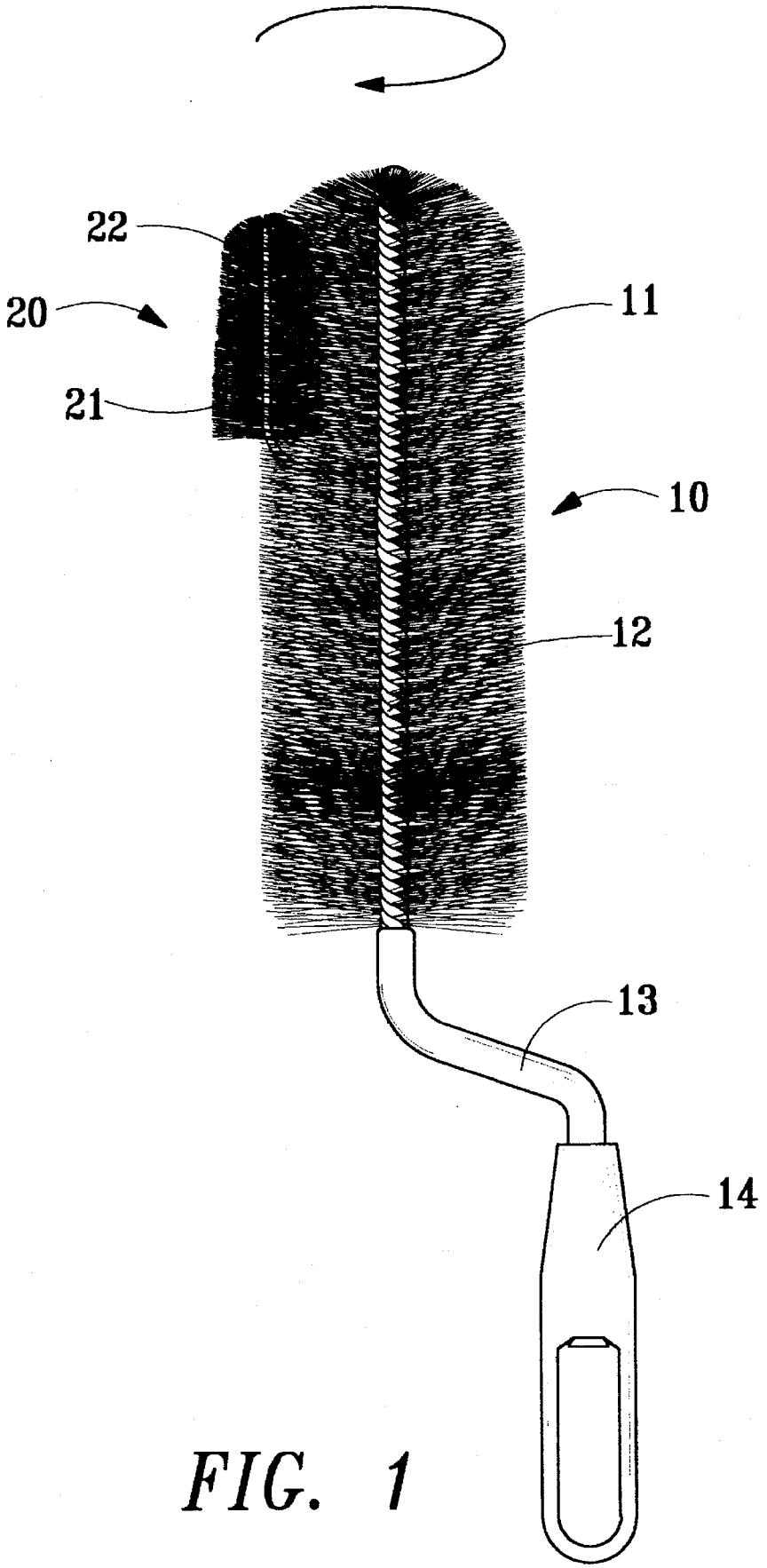
FIG. 1. is the front view first embodiment of the present invention.
Figure 2:
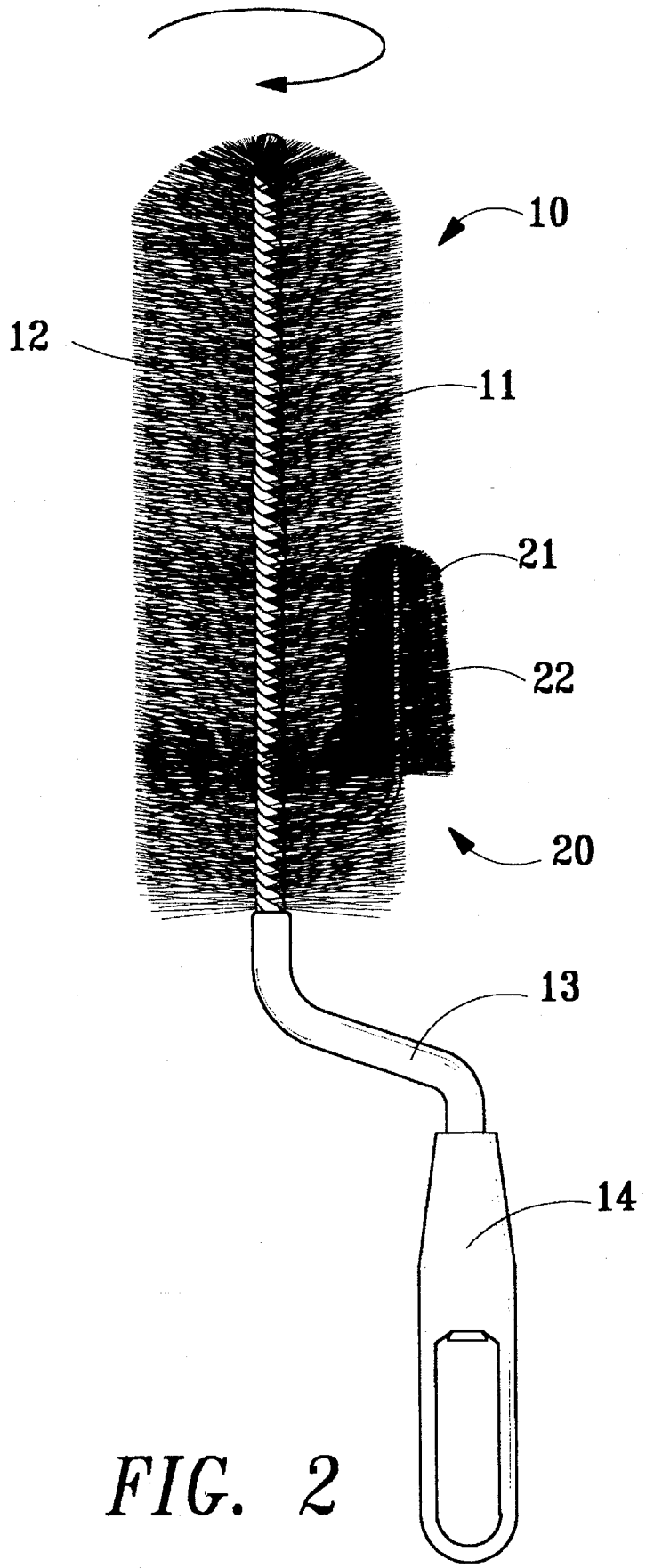
FIG. 2. is the front view second embodiment of the present invention.

Shown from FIG. 1 to FIG. 8 are the illustrations of the present invention of Twin Stemmed Nursing Bottle Brush. Therein, as FIG. 1 of the first embodiment displays the secondary brush 20 extended from the middle portion of the main shaft 12, and extends to the top of the main brush 10; as FIG. 2 of the second embodiment shows the secondary brush 20 extended from the bottom of the main shaft 12 and extends to the middle portion of the main shaft 12. The secondary brush 20 comprises short hair 21 with twisted approach attaching to the secondary shaft 22. At the bottom of the main shaft 12, a "Z" shaped connecting rod 13 is 10 attached to the handle 14 to allow synchronizing rotation to occur. Shown as FIG. 7 of the third embodiment, the secondary shaft 22 of the secondary brush 20 is connected to the middle portion of the "Z" shaped connecting rod 13.

Figure 3:
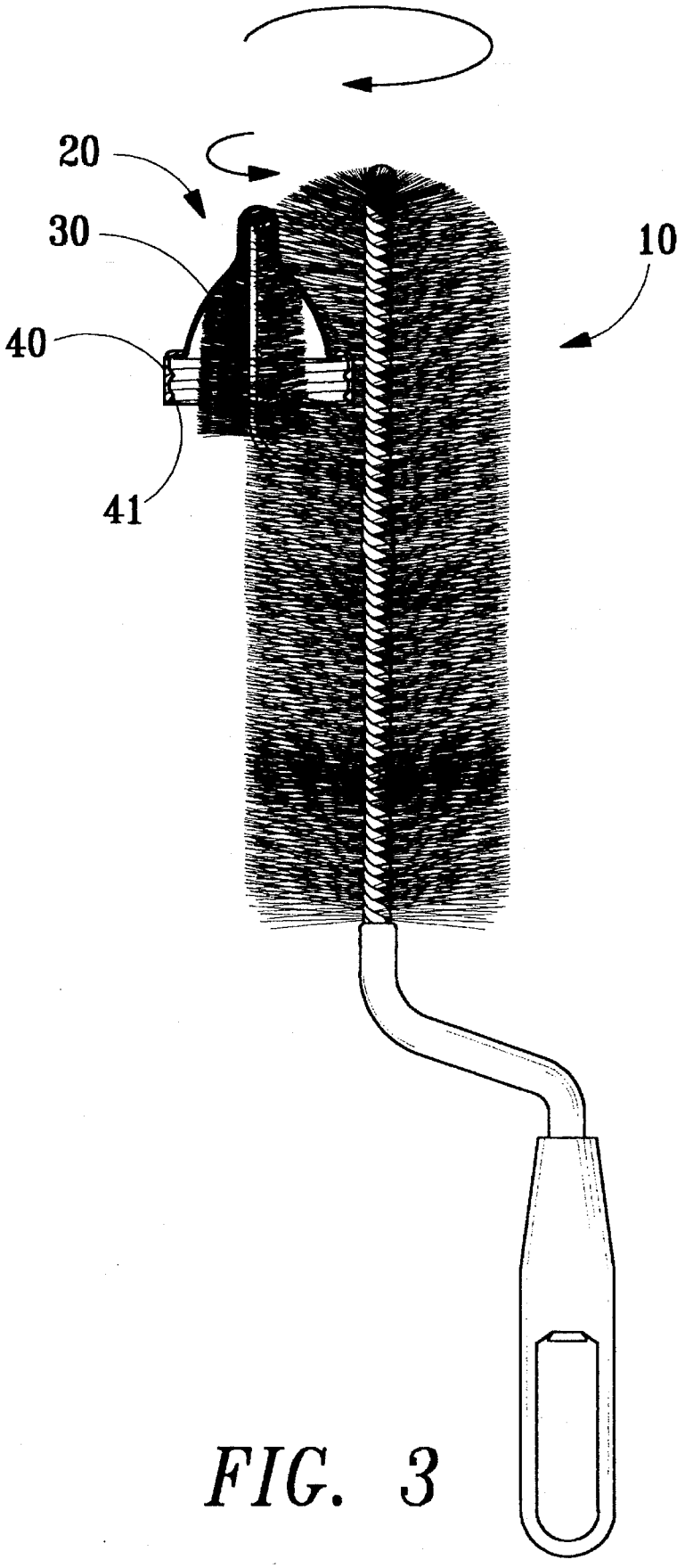
FIG. 3. is the operation diagram of FIG. 1.
Figure 4:
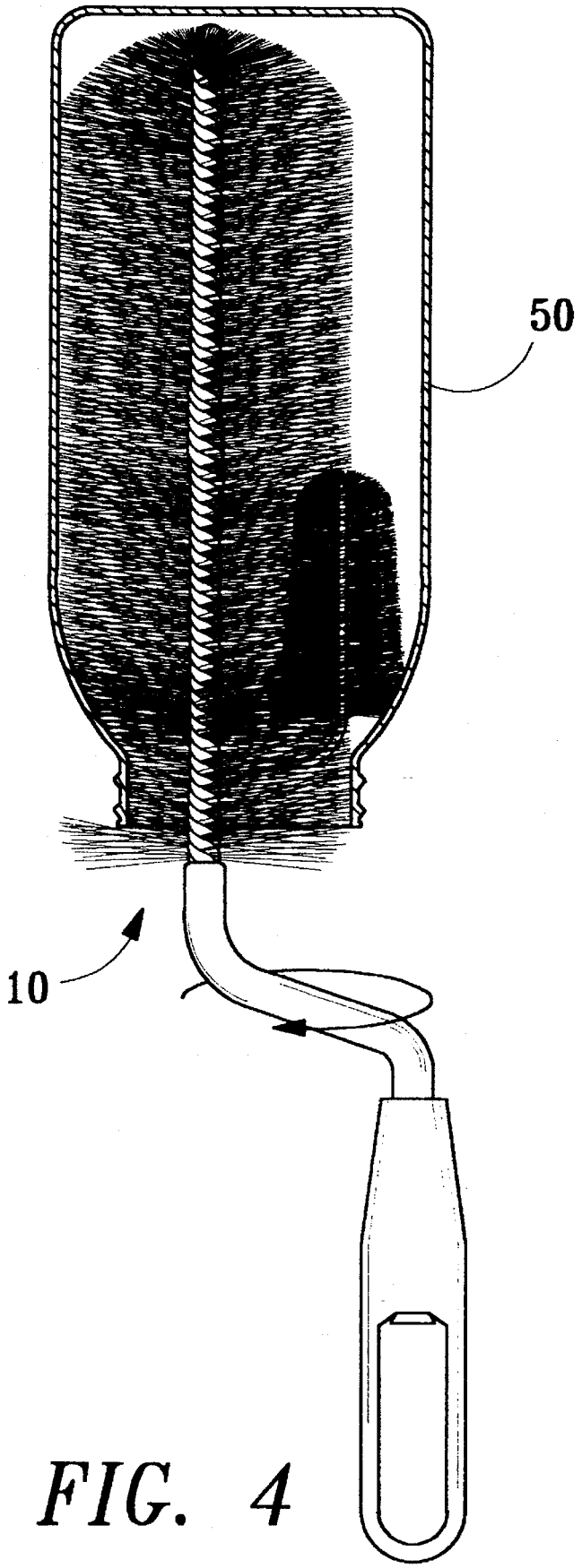
FIG. 4. is the operation diagram of FIG. 2.
Figure 5:
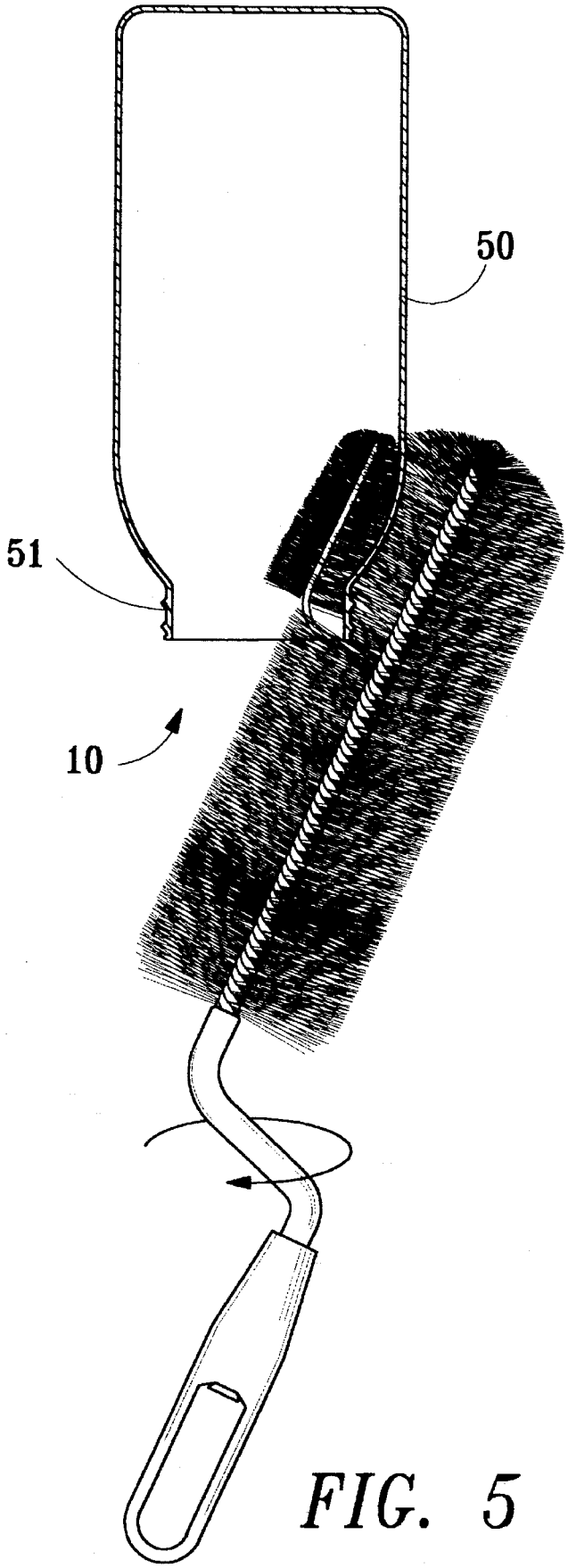
FIG. 5. is another operation diagram of FIG. 1.
Figure 6:
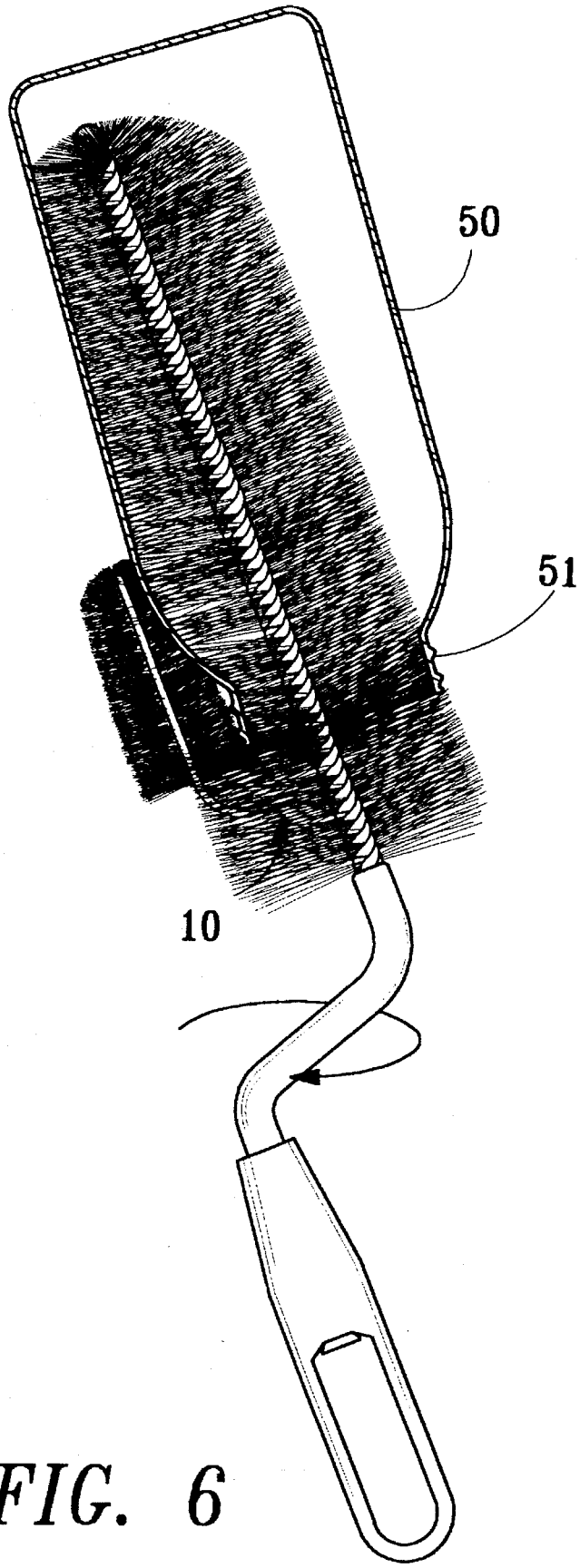
FIG. 6. is another operation diagram of FIG. 2.
Figure 7:
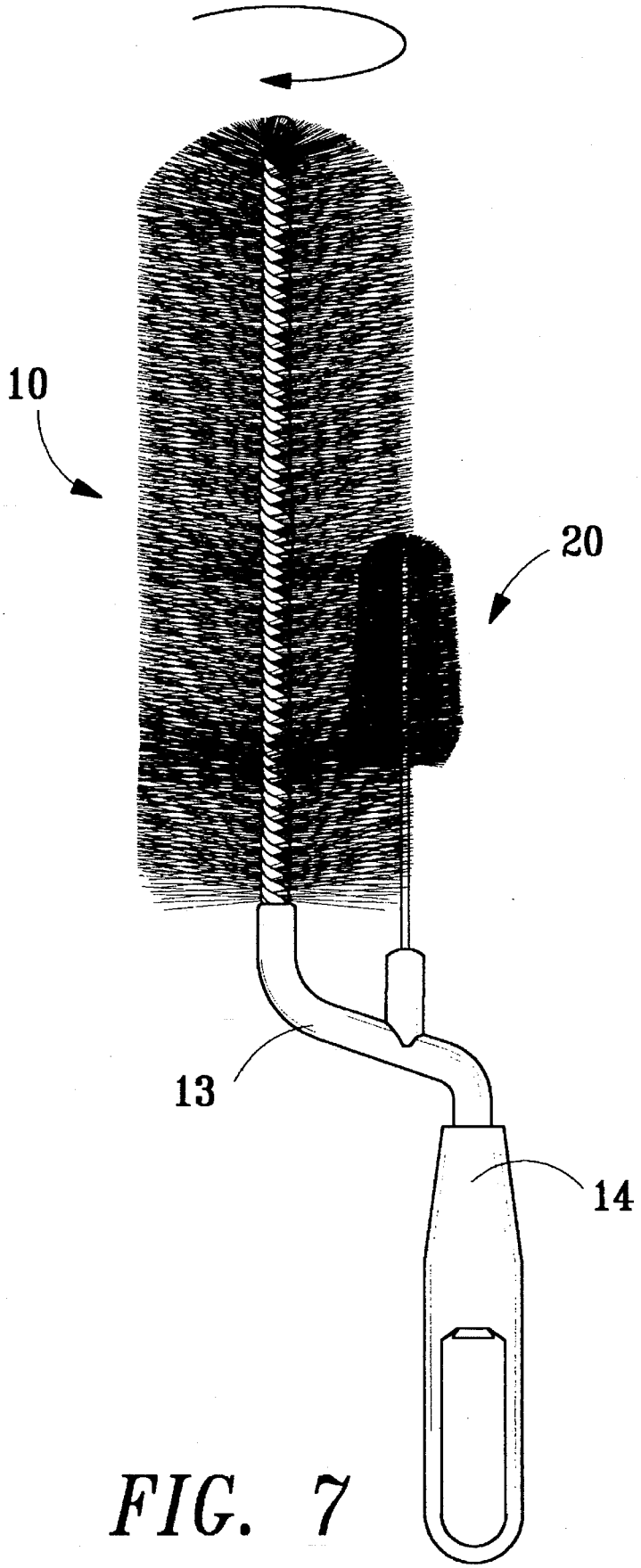
FIG. 7. is the front view third embodiment of the present invention.
Figure 8:
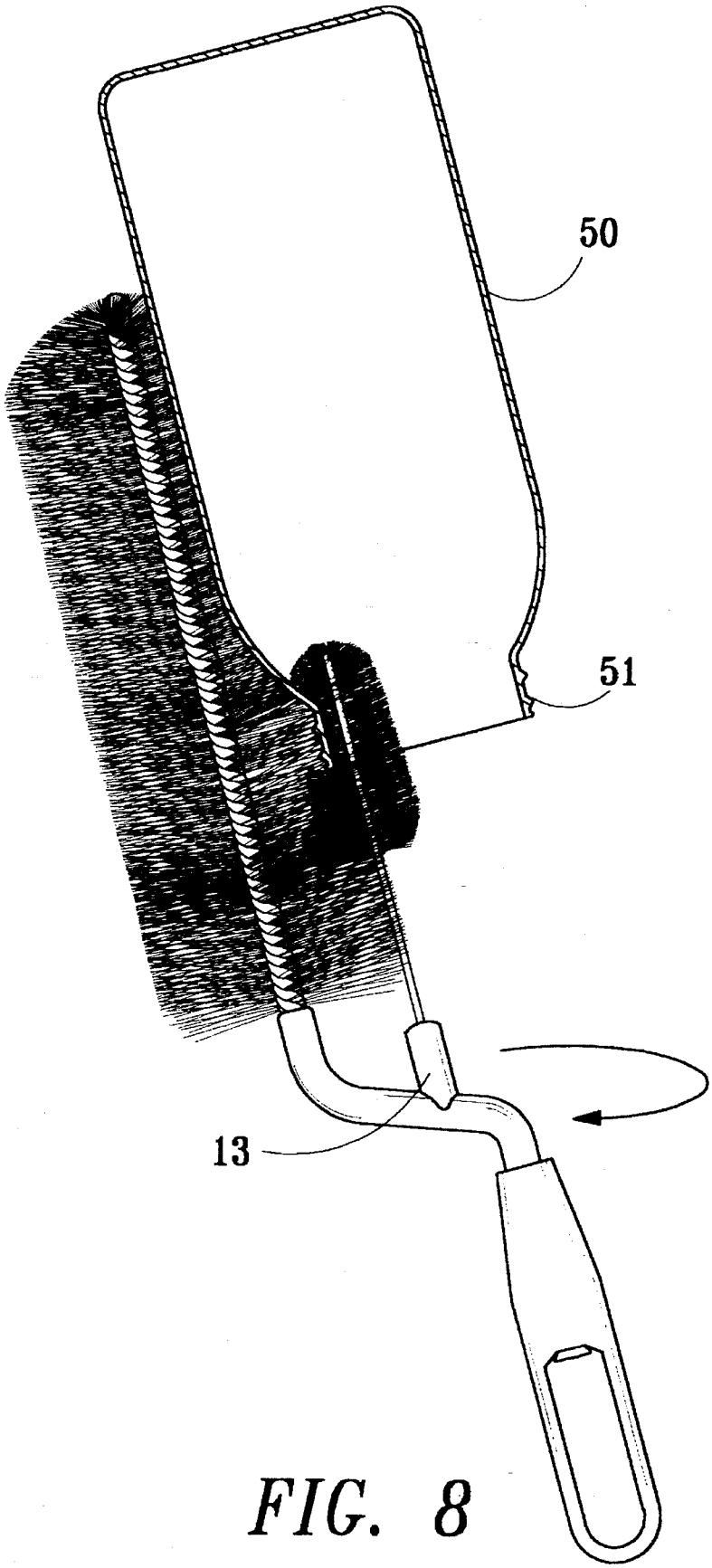
FIG. 8. is the operation diagram of FIG. 7.

Shown on FIG. 3, when cleaning pacifier 30 is attached to the nipple cover 40, the rotating motion of main brush 10 allows the hair 22 of the secondary brush 20 cleans the inner threads 41 of nipple cover 40 and the inner portion of pacifier 30, and the hair 11 of the main brush 10 may clean the outer portion of the nipple cover 40 and the exterior of the pacifier 30; of course, the cleaning may also be achieved through rotating the connecting body of pacifier 30 and nipple cover 40. This may also illustrate the application of FIG. 2 the second embodiment by that shown as in FIG. 4, the main brush 10 along with secondary brush 20 may be sleeved into the bottle 50 to clean the inner portion of the bottle 50 which is not influenced by the function of the secondary brush 20. Shown as FIG. 5 and FIG. 6, the blind spots of outer threads 51 on bottle 50 may be cleaned with ease. Shown as FIG. 8, the outer thread 51 of bottle 50 and the exterior of the bottle 50 may be cleaned by the main brush 10 by rotating either bottle or brush. The rest of the bottle cleaning motions are similar to the above described.

Thus, the present invention of one-bodied twin stemmed nursing bottle brush is indeed an effective cleaning device to offer convenient and swift operation, is also to prevent the loss of the conventional small brush.

Many changes and modifications in the above described embodiment of the invention can, of course, be carried out without departing from the scope thereof. Accordingly, to promote the progress in science and the useful arts, the present invention is disclosed and is intended to be limited only by the scope of the appended claims.

What is claimed is:

1. A twin stemmed nursing bottle brush comprising:

a main brush that is generally cylindrical in shape and has a longitudinal cross section that includes a circular terminal end, said main brush is formed around a main brush shaft, a secondary brush smaller in length and diameter than said main brush, said secondary brush s also generally cylindrical in shape and has a longitudinal cross section that includes a circular terminal end, said secondary brush is formed around a secondary brush shaft, a Z-shaped connecting rod having first and second ends, and a handle connected to said first end of z-shaped connecting rod; wherein said main brush shaft is connected to said second end of said z-shaped connecting rod, and wherein said secondary brush shaft extends from one of said z-shaped connecting rod and said main brush shaft so that said secondary brush is a parallel to said main brush.

2. The nursing bottle brush of claim 1, wherein:

said secondary shaft extends from said main shaft.

3. The nursing bottle brush of claim 1, wherein:

said secondary shaft extends from said Z-shaped connecting rod.

* * * * *